US006893178B2

(12) United States Patent
Liu

(10) Patent No.: US 6,893,178 B2
(45) Date of Patent: May 17, 2005

(54) OFFSET PEN STRUCTURE

(76) Inventor: Bao-Shen Liu, 2F1., No. 65-1, lane 3, Sec. 2,Daguan Rd., Banchiau City, Taipei (TW)

( * ) Notice: Subject to any disclaimer, the term of this patent is extended or adjusted under 35 U.S.C. 154(b) by 0 days.

(21) Appl. No.: 10/658,287

(22) Filed: Sep. 10, 2003

(65) Prior Publication Data

US 2004/0076461 A1 Apr. 22, 2004

Related U.S. Application Data

(63) Continuation-in-part of application No. 09/926,655, filed on Nov. 29, 2001, now abandoned.

(51) Int. Cl.[7] ..... B43K 27/04

(52) U.S. Cl. ..... 401/17; 401/19; 401/34; 401/57; 401/89; 401/90

(58) Field of Search ..... 401/17–20, 34, 401/35, 56, 57, 88–90

(56) References Cited

U.S. PATENT DOCUMENTS 1,619,508 A * 3/1927 Gronberg ..... 401/57

3,918,819 A * 11/1975 Liu ..... 401/57

* cited by examiner

*Primary Examiner*—Gregory L. Huson
*Assistant Examiner*—Peter deVore
(74) *Attorney, Agent, or Firm*—Rosenberg, Klein & Lee

(57) ABSTRACT

The present invention relates to an offset pen comprising a holding portion, a writing portion, and an intermediate portion, in which said holding portion is provided for a user to operate by hand, said writing portion is provided with a pen tip for writing, in which a pen tip seat is provided outside the pen tip, and said intermediate portion is used to connect the holding portion and the writing portion so that the writing portion and the holding portion are separately formed on different axes and that a visible space is formed between said writing portion and said holding portion; therefore, when the user operates, the holding portion naturally tilt, while the writing portion keeps vertical to a writing surface for the sake of different axes, so that the user may promptly see the writing result through the visible space; furthermore, a storage chamber is provided in the holding portion, in which pen tips ready for replacement are stored in the storage chamber so that storage and use of the tips may be implemented from the two ends of the storage chamber.

16 Claims, 8 Drawing Sheets

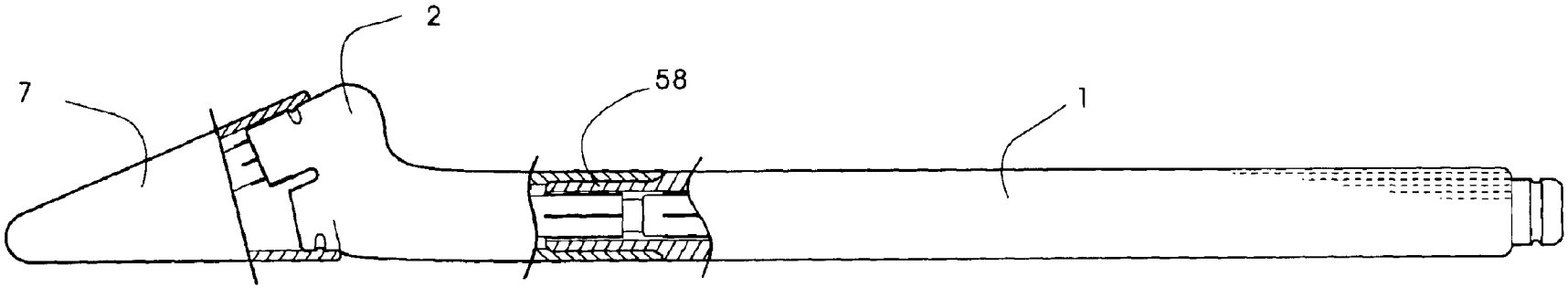
FIG. 13
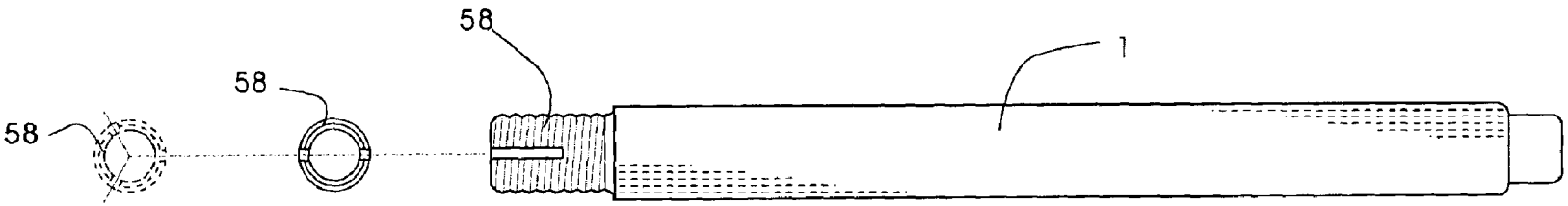
FIG. 14
FIG. 14A
FIG. 14B

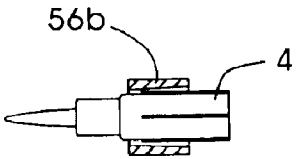
FIG. 15A
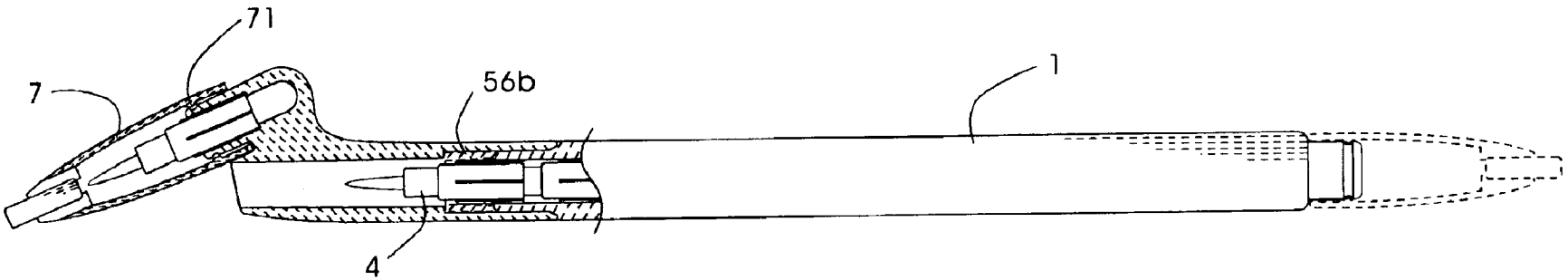
FIG. 15
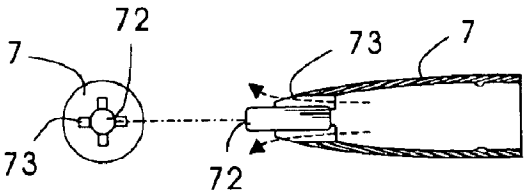
FIG. 15B
FIG. 15C

OFFSET PEN STRUCTURE

CROSS REFERENCE OF RELATED APPLICATION

The present invention is a Continuation-in-part (CIP) application of a pending non-provisional patent application with application Ser. No. 09/926,655 filed on Nov. 29, 2001, now abandoned.

BACKGROUND OF THE INVENTION

1. Field of the Invention

The present invention relates to an offset pen, and more particularly to an improved offset pen structure for comfortable holding, enhanced functions, and easy making.

2. Background of the Invention

So far, conventional writing tools such as fountain pen, pencil, ball point pen, coloring pencil and writing brush on the market have been all linear in shape. That is, a writing head and a holding stick of the writing tool are substantially coaxial. Owing to the limit of people's palm structure, the writing tool generally tilts rearward the wrist while being used so that the vision line of the user will be obstructed by the writing tip of the writing tool.

As such, in order to control writing, a writer must during operation adjust his/her postures all the time or even sometimes improperly hold the writing tool so as not to keep a good habit of writing and to do harm to hand and vision.

Currently, a method of offset pen is provided to solve the aforementioned problems; namely, the connecting structures of a holding portion and a writing portion of the writing tool are changed and the two portions are separately formed on different axes. Herein, the user may still keep the original writing posture, and the writing portion is approximately vertical to the working surface. Also, the writer's eyesight is not covered, so the stable writing work may reduce the load of the writer.

However, due to the conventional offset pen's fixed structures and dull functions, a tip of the pen may not be easily replaced in accordance with the request of the user, and in the cause of co-operation with the offset structures, a tip shape and an ink passage must be irregularly curved following a pen type, thereby increasing a difficulty in making and the cost so as to be disadvantageous to the consumers.

SUMMARY OF THE INVENTION

This invention is to provide an offset pen and the offset pen mainly comprises a holding portion, a writing portion, and a intermediate portion, in which said holding portion is provided for the user to hold during operation, said writing portion is provided to allow a tip for the user to write, and said intermediate portion is connected between the holding portion and the writing portion so that the writing portion and the holding portion is separately formed on different axes for achievement of the writing function of offset pen.

With demands the tip of offset pen may be changed into different types, such as a pencil, coloring pencil, charcoal, wax pen, power coloring pen and so on, in which spare tips are allowed in the chamber of holding portion. In this invention, a visible space is formed between the writing portion and the holding portion; the visible space is provided for the writer to keep the space under observation so as to at any moment control the writing conditions and to keep a good posture to write. Furthermore, in order to prevent the tip from drawing back, the writing portion is provided with a fixing pillar, in which the fixing pillar may be flexible in length, depending on the tip type, for location of the tip inserted. Next, for ease of the holding portion, a polygonal holding side is provided on the surface of the holding portion, and a triangular form is preferable for the writer to comfortably hold.

BRIEF DESCRIPTION OF THE DRAWING

The present invention may best be understood through the following description with reference to the accompanying drawings, in which:

FIG. 13 is a view of a blocking piece according to an embodiment of the present invention;

FIG. 14 is a schematic view of a structure of the blocking piece according to the present invention;

FIG. 14A is an end view of the blocking piece according to the present invention;

FIG. 14B is an end view of the blocking piece according to another embodiment of the present invention;

FIG. 15 is an illustration of the confined edge configuration according to a third embodiment of the present invention;

FIG. 15A is a structural illustration of the confined edge configuration according to the third embodiment of the present invention;

FIG. 15B is an illustration of a cap configuration of the confined edge according to the third embodiment of the present invention;

FIG. 15C is an end view of the cap of the confined edge according to the third embodiment of the present invention;

DETAILED DESCRIPTION OF THE PREFERRED EMBODIMENTS

Figure 1:
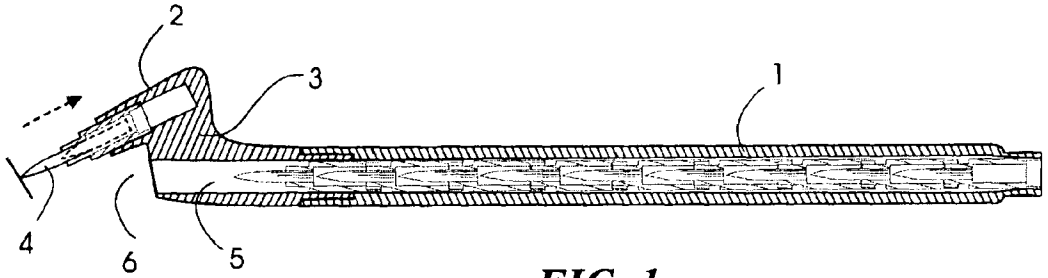
FIG. 1 is a view of the writing tip structure according to the present invention.

Referring to FIG. 1, the present invention provides an offset pen, mainly comprising a holding portion 1, a writing portion 2, and a intermediate portion 3. The holding portion 1 is provided for a user to hold by hand during operation, in which an storage chamber 5 is provided; the writing portion 2 is used to load a writing tip 4 capable of keeping a mark, which enables the user to write, and the outside of said tip 4 is provided with a tip seat 41 to give a support in the case of loading; the intermediate portion 3 is connected between the front end of said holding portion 1 and the back end of said writing portion 2 so that the front end of said writing portion 2 is made to bend in the direction of the holding portion and then the writing portion 2 and the holding portion 1 are made to be separately provided on different axes, thereby fabricating the offset pen structure of this invention.

A visible space is formed between the writing portion 2 and holding portion 1 of the offset pen, and the visible space 6 provides the user a viewing area in writing so as to control the writing condition at any moment. Further, the storage chamber 5 in the holding portion 1 extends through a intermediate portion 3 so that two openings 51 and 52 are formed respectively at the two ends, which may store a plurality of writing tips 4, required for replacement, capable of marking.

Figure 2:
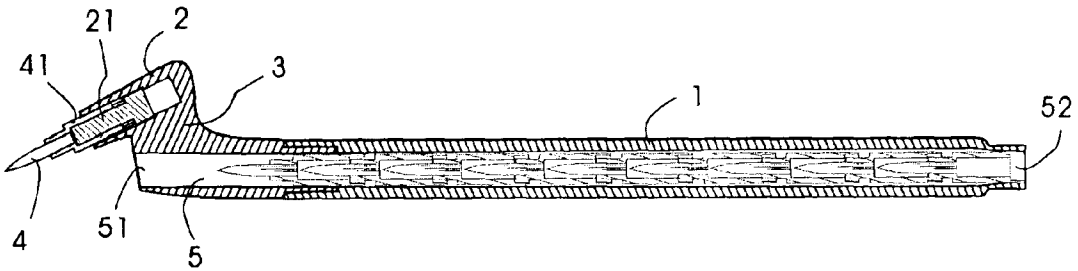
FIG. 2 is an illustration of the fixing pillar configuration according to the present invention.

In accordance with FIG. 2, for fear of the writing tip 4 probably drawing back from a pressure applied in writing, the writing portion 2 according to the present invention is provided with a fixing pillar 21 so that the fixing pillar 21 may go deep into the writing tip seat 41 to inside hold the back end of the writing tip 4 for smooth writing when the writing tip seat 41 is fixed to the writing portion 2.

Figure 3:
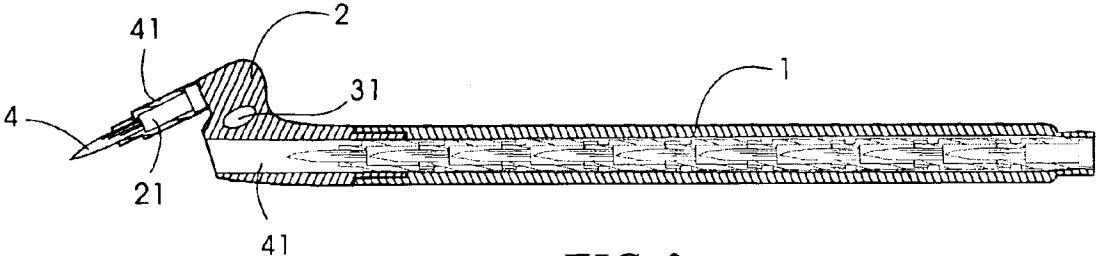
FIG. 3 is an illustration of the fixing pillar configuration according to another embodiment the present invention.

Referring now to FIG. 3 as FIG. 2, a fixing pillar 21 may be directly formed at the front end of the writing portion 2 so that the fixing pillar 21 may hold to prevent the writing tip 4 from drawing back when the writing tip seat 41 covered around the fixing pillar 21 from outside.

The aforementioned intermediate portion 3 of the offset pen is provided with one or more aesthetic hole 31, in which said aesthetic hole 31 is in the form of random geometry for enhancement of the aesthetic perception in the product.

Figure 4:
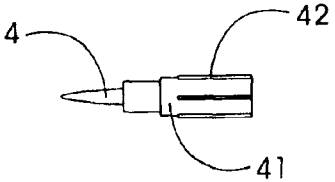
FIG. 4 is an illustration of the enhanced rib of the writing tip according to the present invention.

According to FIG. 4, for smooth writing, the writing tip 41 must be closely contacted together wither the writing portion 2, but it is difficult to pull out the writing tip 4 for replacement; for this reason, a protruding rib 42 is provided on the surface of the writing tip seat 41 so that the writing tip seat 41, closely contacted with the writing portion 2, may also be smoothly drawn out of the writing portion 2.

Figure 5A:
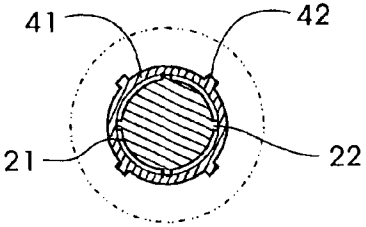
FIG. 5A of a sectional view of A—A according to FIG. 5.
Figure 5:
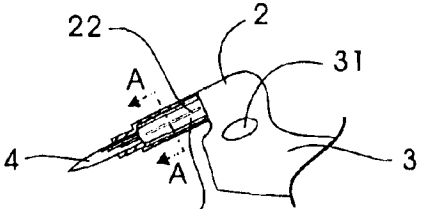
FIG. 5 is an illustration of the enhanced rib configuration of fixing pillar according to the present invention.

Referring to both FIG. 5 and 5A as FIG. 4, a protruding enhancement rib 22 is provided on the surface of the fixing pillar 21 in order to reduce friction so that the fixing pillar 21, closely contacted with the writing tip seat 41, may also be smoothly drawn out of the writing tip seat 41.

Figure 6:
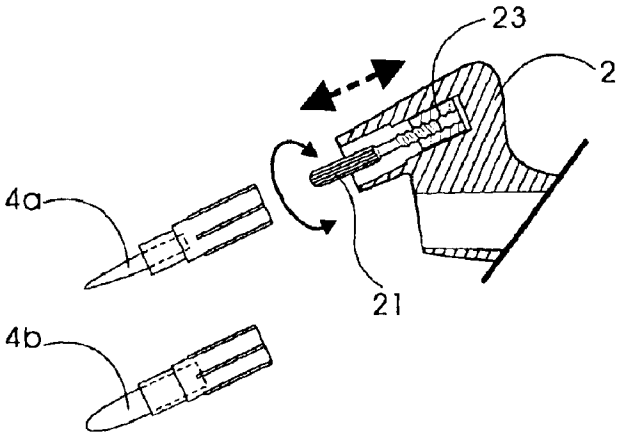
FIG. 6 is an illustration of the fixing pillar rotation according to the present invention.

According to FIG. 6, the fixing pillar 21 is locked at the writing portion 2 with the thread 23 of a screw or locked otherwise; the fixing pillar 21 may be flexible in length by rotation to adapt to the protruding position of the writing tips 4*a* and 4*b* with different specifications.

Figure 7:
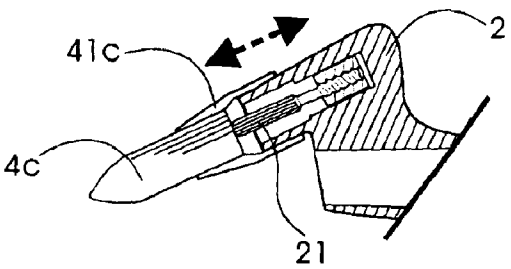
FIG. 7 is an illustration of a larger seat allowing a writing tip according to the present invention.

According to FIG. 7, the designed writing tip seat 41*c* following the required specification may be located at the writing portion 2 from outside and then may make the writing tip 4*c* still supported by the fixing pillar 21.

Figure 8:
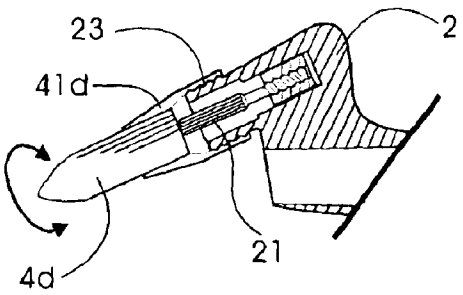
FIG. 8 is an illustration of the larger seat allowing the writing tip according to another embodiment of the present invention.

According to FIG. 8 following the design in FIG. 7, the writing tip 4*d* and the writing tip seat 41*d* are locked at the writing portion 2 with the thread 23 of a screw or locked otherwise for enhancement of smooth writing.

Figure 9:
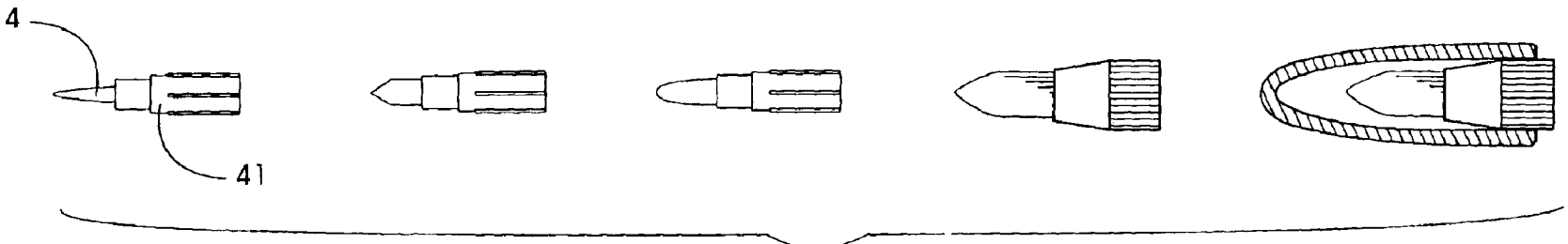
FIG. 9 is a schematic drawing of a writing tip type according to the present invention.

According to FIG. 9, this writing tip required for the writing tip seat 41 may be a pencil tip, a coloring pencil tip, a charcoal tip, a wax writing tip, a power coloring writing tip, a rubber tip, water fiber writing tip, water animal hair writing tip, water chemical fiber writing tip, water plastics-combined writing tip and so on.

Figure 10:
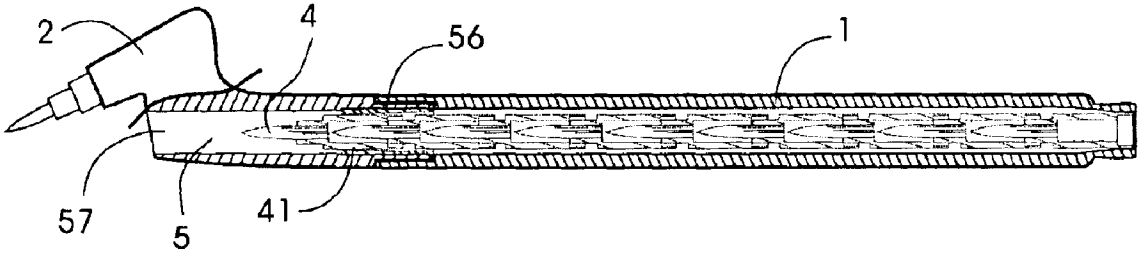
FIG. 10 is an illustration of a confined edge configuration according to the present invention.
Figure 11:
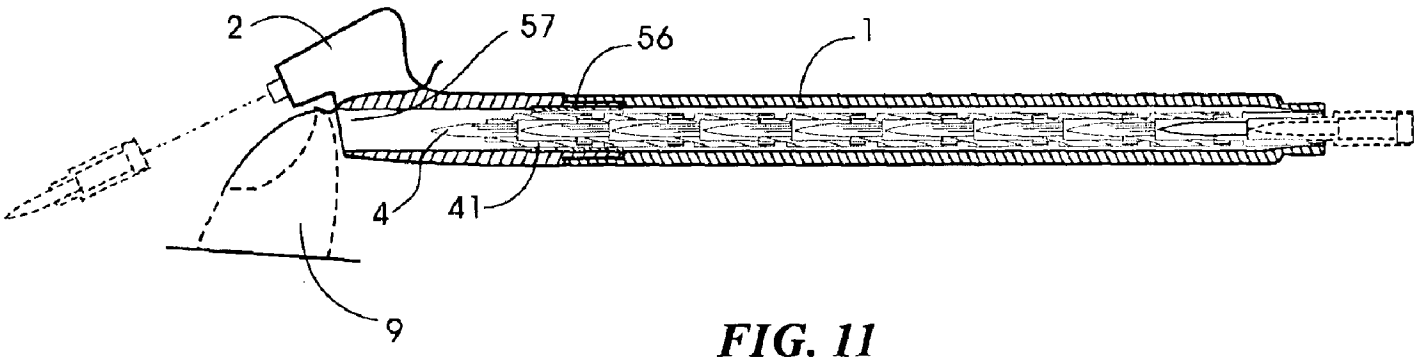
FIG. 11 is a schematic view of the confined edge functionality according to the present invention.

According to FIG. 10 and 11, the front section of the storage chamber 5 is provided with a confining fringe 56 in the form of a ring inserting into the storage chamber 54 from outside so as to fix the writing tip seat 41 of the forefront side; then, it makes the front section of the writing tip seat form a buffer space 57 to stop the writing tip 4 at the forefront side from stretching out to stab the user's hand.

Figure 12:
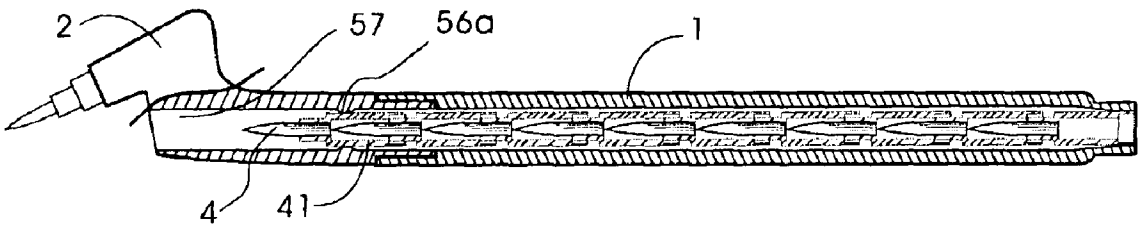
FIG. 12 is an illustration of the confined edge configuration according to another embodiment of the present invention.

According to FIG. 12, a confining fringe 56*a* is also provided in the storage chamber and protrudes.

Referring now to FIG. 13 and 14, the holding portion 1 is structured with multi-sectional joints of which terminal surface is provided with a blocking piece 58, wherein a surface of the blocking piece 58 slightly protrudes and has a gap as shown in FIG. 14A and 14B; when the holding portion 1 is connected, said blocking piece 58 is made to inward protrude so as to form a diameter, somewhat smaller than that of the writing tip seat 41, of being against the writing tip seat 41, thereby functioning as the above-mentioned confined edge 56. Furthermore, the writing portion 2 may be connected with a cap 7 which is buckled into the writing portion 2 with a buckle contact 71, in which the structure is a conventional design, so no more unnecessary details are given herein.

Referring now to FIG. 15, 15A, 15B, and 15C, another confined edge 56*b* is formed, in which the confined edge 56*b* is also a ring type and easily fabricated; the buckle contact 71 of the cap 7, being buckled into the writing portion 2, may also be buckled into the tail of holding portion 1 and a front end of the cap 7 is provided with a rubber 72, in which the cap 7 further has a vent 73 for ventilation.

Figure 16:
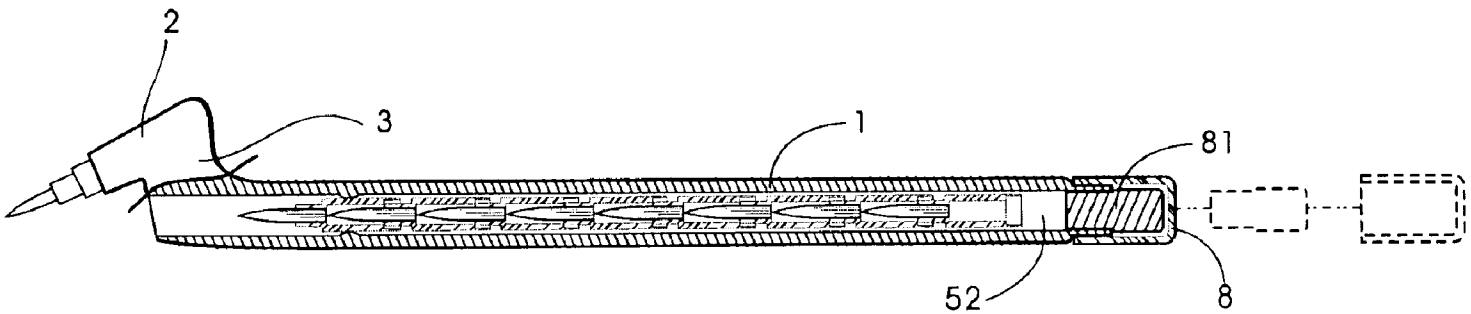
FIG. 16 is an illustration of the allowable chamber structure variations according to the present invention.
Figure 17:
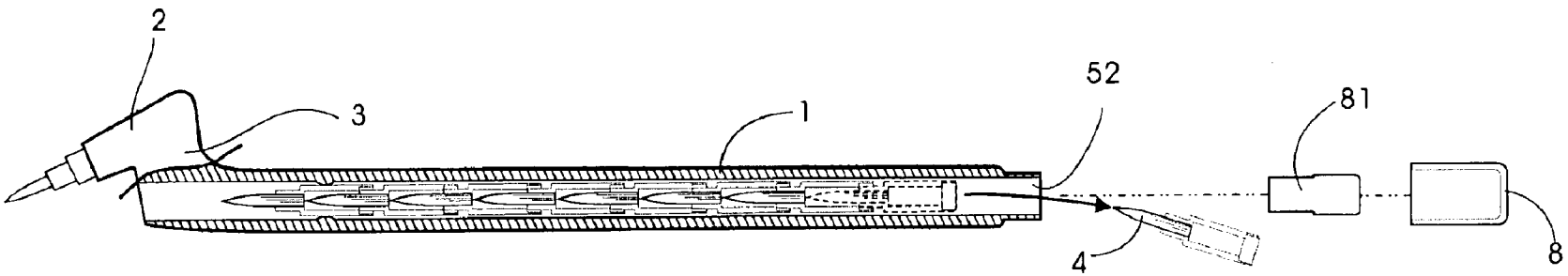
FIG. 17 is an illustration of the operation of the allowable chamber structure variations according to the present invention.

According to FIG. 16 and 17, the holding portion 1, the writing portion 2, and the intermediate portion 3 is all-in-one fabricated, in which a terminal 52 of the storage chamber 5 is an unrestrained opening to push out or insert in the writing tip 4, and in which a cap 8 is used to cover the terminal 52 in order to prevent the contents from dropping out; further, a rubber 81 may be inserted in the terminal 52 for easy use, which will not give unnecessary details due to the structure commonly seen.

Figure 18A:
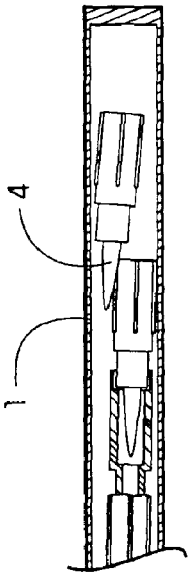
FIG. 18A is a schematic drawing of, according to the present invention, the writing tip blockage before the inner tube is not installed
Figure 18:
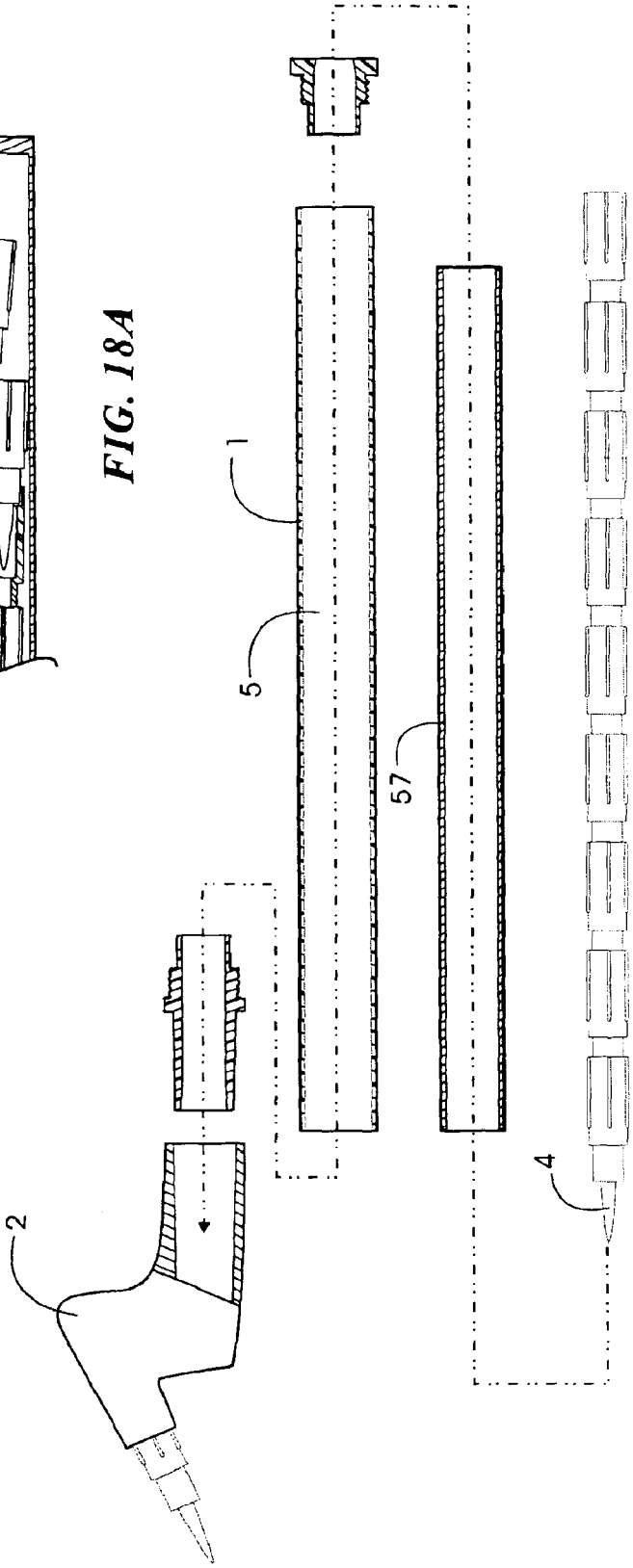
FIG. 18 is an exploded drawing of the offset pen combined with an inner tube according to an embodiment of the present invention.
Figure 19:
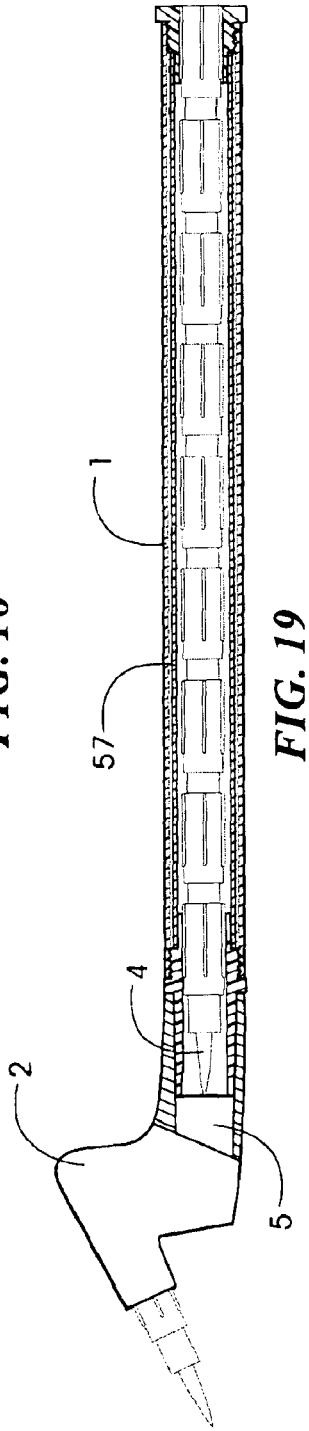
FIG. 19 is an assembly drawing of the offset pen combined with the inner tube according to the present invention.

According to FIG. 18, 18A, and 29, due to the aforementioned storage chamber 5 with a certain diameter, if a writing tip 4 with a small diameter is loaded, all writing tips 4 could lean to one another, they will band together, so an inner tube 57 is provided in said storage chamber 5 according to the present invention, wherein writing tips 4 ready for replacement are contained in said inner tube 57 so that the whole inner tube 57 may be directly replaced with another one, and a distance between the inner tube 57 and the writing tip may be limited to make each writing tip 4 smoothly move without writing tips jam.

Figure 20:
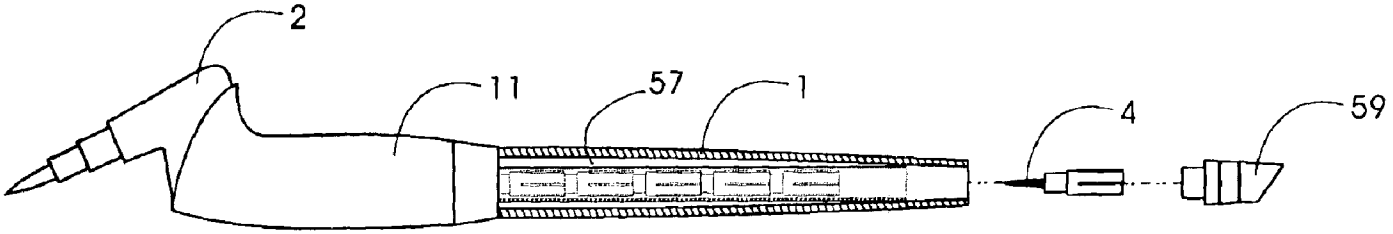
FIG. 20 is a view of the writing tip chamber variation according to another embodiment of the present invention.
Figure 21:
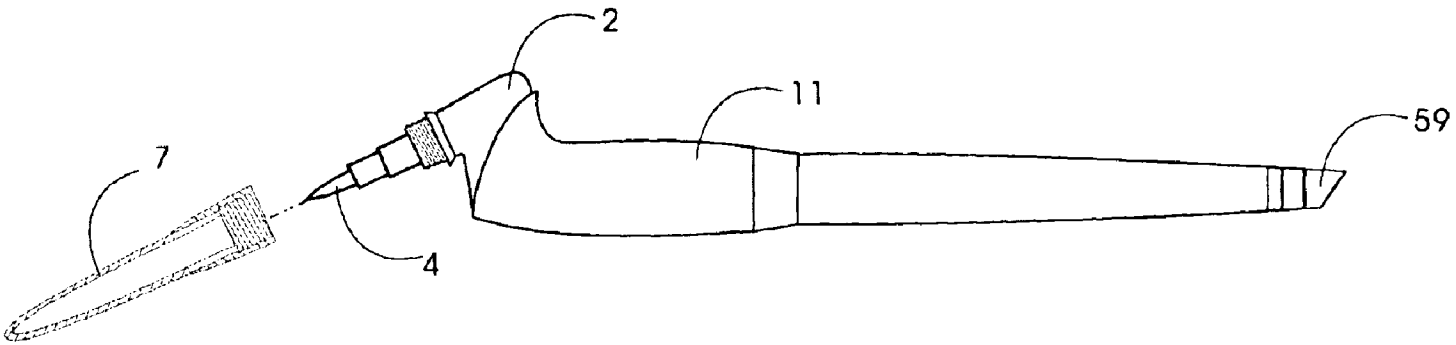
FIG. 21 is a view of the writing tip chamber variation according to an embodiment of the present invention.

According to FIG. 20 and 21, the holding portion 1 is provided with a holding section 11 of which shield is triangular for easy holding; or a tail of the holding portion 1 may be provided with a pillar 59, as another method provided to load the writing tips; indeed, the holding portion 1 resulting from its moldeling may be formed with the inner tube 57 so that the writing tip 4 may be loaded for replacement, and the holding portion 1 is provided with joints connected with each other with screw thread or another equivalent for easy replacement of the inner tube 57.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An offset pen, comprising:

a holding portion provided for a user to operate with a hand and having a longitudinally extended first axis;

a writing portion laterally spaced from said holding portion and having a second axis extending at an inclined angle with respect to said first axis;

a writing tip provided for writing, said writing tip having a writing tip seat formed around an outside of said writing tip for releasable coupling to said writing portion; and, an intermediate portion connected between a front end of said holding portion and a back end of said writing portion so that a visible space is formed between the writing portion and the holding portion;

said holding portion being formed with a longitudinally extended storage chamber for receiving a plurality of writing tips in succession therein, said storage chamber extending to an opening in said intermediate portion for depositing said writing tips into said visible space ready for use as a replacement of said writing tip coupled to said writing portion.

2. The offset pen according to claim 1, in which the writing tip capable of marking is made of a pencil, a coloring pencil, a charcoal, a wax writing, a power coloring writing, a rubber, a water fiber writing tip, a water animal wool writing tip, a water chemical wool fiber writing tip, a water plastics-combined writing tip, all of which tips are in the form of water, oil, and powder solid body.

3. The offset pen according to claim 1, wherein said writing tip seat has a protruding rib formed on a surface thereof for facilitating removal of said writing tip from said writing portion.

4. The offset pen according to claim 1, wherein said writing portion includes a fixing pillar extending therefrom for engagement with said writing tip seat.

5. The offset pen according to claim 4, wherein said fixing pillar has a protruding enhancement rib formed on a surface thereof for reducing friction so that said writing tip seat is smoothly removable from said fixing pillar.

6. The offset pen according to claim 4, wherein said fixing pillar is threadedly engaged with said writing portion and an extension length of said fixing pillar is adjusted inwardly and outwardly responsive to rotation of said fixing pillar relative to said writing portion.

7. The offset pen according to claim 1, wherein a front end of said writing portion has a fixing pillar extending therefrom for engagement by said writing tip for securement thereof to said writing portion.

8. The offset pen according to claim 1, wherein said writing tip seat engages an external surface of said writing portion.

9. The offset pen according to claim 8, wherein said writing tip seat has threads formed on an internal surface thereof and said writing portion has threads formed on said external surface, whereby said writing tip seat is threadedly engaged with said writing portion.

10. The offset pen according to claim 1, wherein a front section of said storage chamber is provided with a confining fringe for fixing a respective writing tip seat of a front-most writing tip, said confining fringe being positioned in said front section to form a buffer space for preventing a stored writing tip from extending into said visible space and contacting a user.

11. The offset pen according to claim 1, further comprising a rubber member disposed at a tail end of said holding portion.

12. The offset pen according to claim 1, wherein said holding portion, said writing portion, and said intermediate portion are formed in one-piece formation.

13. The offset pen according to claim 1, in which the holding portion is provided with a polygonal handhold for smooth holding effect.

14. The offset pen according to claim 13, wherein said holding portion and said handhold are formed in one-piece formation.

15. The offset pen according to claim 13, in which the handhold may be made of soft materials and additionally covered around the holding portion for the user to smoothly hold by hand.

16. The offset pen according to claim 1, further comprising an inner tube is disposed in said storage chamber, wherein writing tips ready for replacement are contained in said inner tube so that the whole inner tube may be directly replaced with another one, and a distance between the inner tube and the writing tip may be limited to make each writing tip smoothly move without jamming.

* * * * *